United States Patent [19]

Sato

[11] Patent Number: 4,929,297

[45] Date of Patent: May 29, 1990

[54] SPLICING SYSTEM

[75] Inventor: Hiroshi Sato, Hiroshima, Japan

[73] Assignee: Mitsubishi Jukogyo Kabushiki Kaisha, Tokyo, Japan

[21] Appl. No.: 301,101

[22] Filed: Jan. 25, 1989

[51] Int. Cl.[5] ..... B65H 19/14

[52] U.S. Cl. ..... 156/361; 156/504; 242/58.1

[58] Field of Search ..... 156/501, 505, 495, 361; 242/58.1, 58.5

[56] References Cited

U.S. PATENT DOCUMENTS

| | | | |
|---|---|---|---|
| 3,713,600 | 1/1973 | Murray et al. | 242/58.4 |
| 3,971,524 | 7/1976 | Nudinger et al. | 156/504 |
| 4,009,814 | 3/1977 | Singh | 226/113 |
| 4,100,012 | 7/1978 | Meihofer et al. | 156/504 |

FOREIGN PATENT DOCUMENTS

| | | |
|---|---|---|
| 2117449 | 7/1972 | France . |
| 8702019 | 4/1987 | PCT Int'l Appl. . |
| 2056953 | 3/1981 | United Kingdom . |

*Primary Examiner*—Michael Wityshyn

*Attorney, Agent, or Firm*—Bernard, Rothwell & Brown

[57] ABSTRACT

The known splicing system for paying out a rolled sheet and continuously feeding a sheet to a downstream machine of the type that the system includes a sheet splicer for stopping a running sheet and splicing a tip end of another new sheet therewith, a tension roll in a dancer roll section for forming a sheet pool downstream of that sheet splicer, which tension roll is provided for the purpose of feeding the running sheet without changing the speed of the downstream machine, an accelerating roll for stopping a running old sheet and accelerating the new sheet upstream of the dancer roll section and downstream of the sheet splicer, and a guide roll provided downstream of the dancer roll section and upstream of the downstream machine for feeding the sheet coming from the dancer roll section to the downstream machine in the prior art, is improved. The improvements reside in that when a rotational speed of the accelerating roll is represented by $-N_2$, a rotational speed of the guide roll is represented by $+N_3$, and a rotational speed of a drive shaft for moving the tension roll in the dancer roll section is represented by $N_1$, the drive shaft is driven so as to fulfil the relation of $$N_1 = \frac{(-N_2) + N_3}{2},$$

and thereby variation of the tension in the sheet applied to the tension roll accompanying the variation of the rotational speed of the accelerating roll can be made zero.

2 Claims, 4 Drawing Sheets

FIG. 4a
PRIOR ART
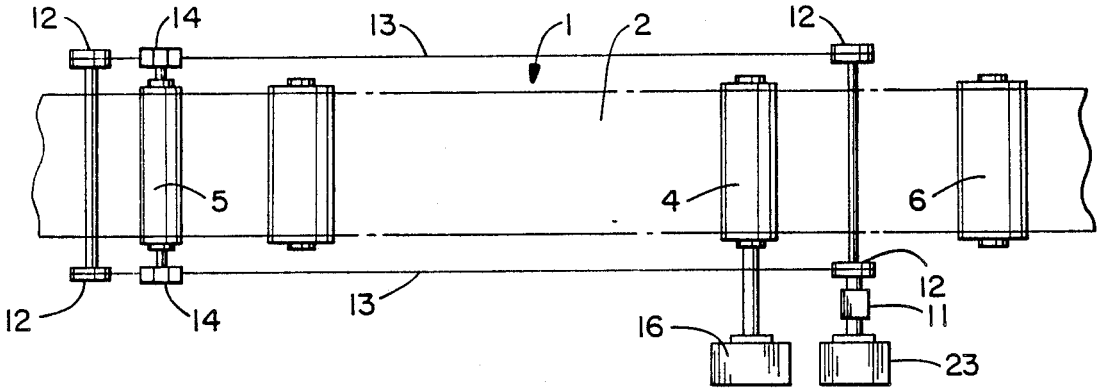
FIG. 4b
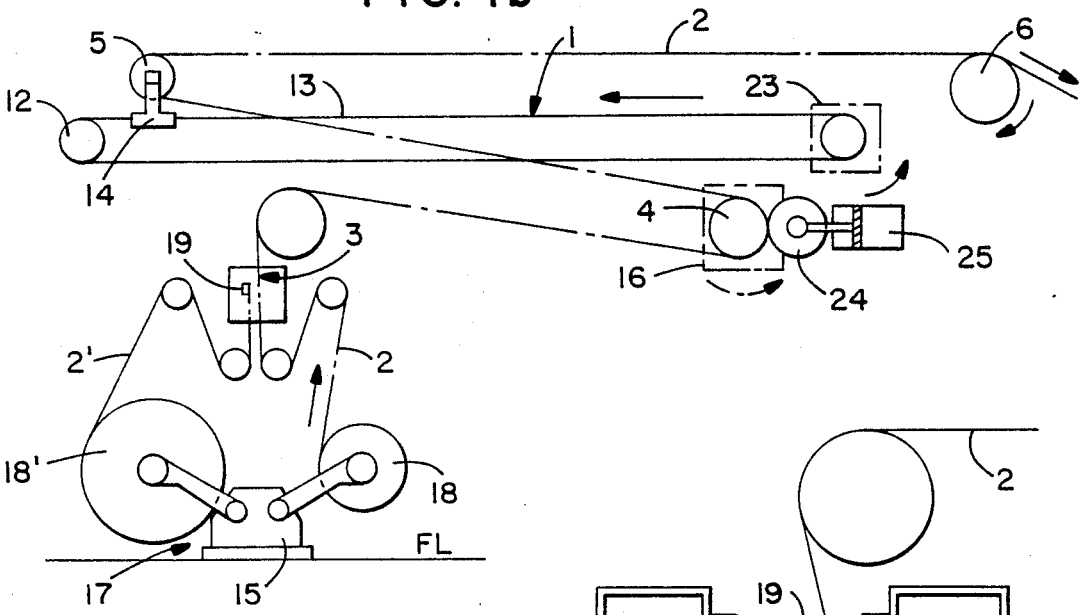
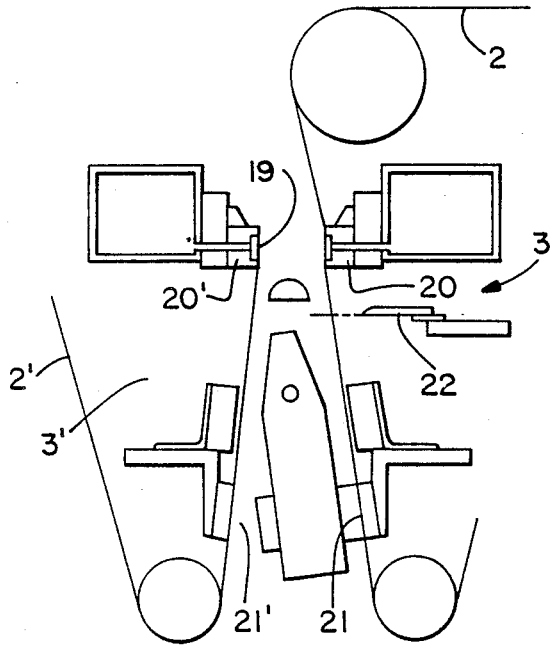
FIG. 5
PRIOR ART

SPLICING SYSTEM

BACKGROUND OF THE INVENTION

1. Field of the Invention

The present invention relates to a splicing system, which is applicable to a control section for a dancer roll moving speed of a corrugate machine, a printing machine provided with an intermittent feeding device of a continuous sheet, a dancer roll section in a winder, and the like.

2. Description of the Prior Art

A general construction of one example of a splicing system for use in a corrugate machine in the prior art is shown in FIGS. 4 and 5. Principal components of the illustrated apparatus are a raw material sheet feeder section 17, a sheet splicer section 3 and a dancer roll section 1. The raw material sheet feeder 17 is a device, in which a rolled sheet 18 consisting of a raw material sheet is rotatably supported via a shaft by a mill roll stand 15 and the sheet is successively rewound and fed in accordance with a necessary feed rate for manufacturing a corrugated cardboard sheet. The subsequent sheet splicer 3 is a device, in which in the case of order change or in the case where an old sheet 18 has been used up, a continuous sheet is formed by connecting the old sheet 18 to a new sheet 18'. The dancer roll section 1 is a section operable in such manner that since the splicing work is carried out while the feeding of the raw material sheet is kept stopped, a length of raw material sheet spent during that splicing work and to be supplemented later is preliminarily stored in the section so that the corrugated cardboard sheet can be manufactured continuously.

Now description will be made briefly on the method (procedure) for splicing. At first, a tip end of a new sheet 2' paid out of a rolled sheet 18' on a mill roll stand 15, has a double-face adhesive tape 19 applied onto its surface after a cutting treatment, its back surface is sucked and held by a press-adhesion bar 20', and stands by under the condition shown in FIG. 5. On the other hand, with regard to the running old sheet 2, an accelerating roll 4 is decelerated by carrying out speed control of a motor 16, the sheet feeding speed is reduced by a braking action of a press roll 24 which pinches the sheet 2 jointly with the accelerating roll 4, further in a sheet stopper section 21 the sheet 2 is pinched by paired bars to be perfectly stopped, and then the stopped old sheet is spliced with the new sheet 2' via the double-face adhesive tape 19 by means of the press-adhesion bar 20'. The thus spliced sheet is pulled by the pinching rotation of the acceleration roll 4 and the press roll 24, and is fed to the dancer roll section 1. After predetermined acceleration, the acceleration roll 4 feeds the sheet to the dancer roll section 1 at a somewhat faster speed than the rate of ejecting the sheet from the dancer roll section 1 and consuming it at the next step of the process, and thus it functions to supplement the stocked amount of sheet that was consumed during the splicing operation. It is to be noted that in FIGS. 4(*a*) and 4(*b*), a motor 23 always continues to rotate at a predetermined speed for moving a pair of bearings 14 for a tension roll 5 connected to chains 13 at one location via a powder clutch 11 and sprockets 12, and thereby a proper tension is applied to the sheet being ejected. In the above-mentioned powder clutch 11 which is one kind of electromagnetic disc clutches, finely crushed dry magnetic particles are filled in the space between clutch elements, and a predetermined torque can be set by regulating a current flowing through the powder. It can operate also as a safety device such that in the event that an excessively large torque has been exerted upon the clutch elements, they would slip relative to each other and absorb the exerted torque.

The splicing system in the prior art is constructed and operates in the above-described manner, hence upon sheet splicing work, in the event that the accelerating roll 4 and the press roll 24 have been momentarily decelerated or stopped, as the sheet speed for ejecting the sheet from the dancer roll section 1 to the next step of the process is a constant speed, the tension roll 5 would be pulled back against the inertia of the dancer roll section 1 and the tension roll 5, and so, abrupt change of the sheet tension would appear in the running sheet as shown in FIG. 3(*c*). On the contrary, after the sheet splicing work, as the feed speed of the sheet 2 is accelerated by the acceleration of the accelerating roll 4, it is necessary to decelerate the moving speed of the tension roll 5 in the pull-back direction, that is to accelerate the moving speed in the normal direction. However, this system had structural shortcomings that if this deceleration (i.e., acceleration in the normal direction) is slower than the acceleration of the sheet 2, the sheet 2 would slacken, while if the feed speed of the sheet 2 is insufficient, the dancer roll would continuously run in the pull-back direction and would strike against a limit stopper, resulting in break of the sheet 2.

In summary, in the above-described sheet splicing system in the prior art, since the splicing between new and old sheets is carried out in the course when a corrugated cardboard sheet is being manufactured successively, upon the splicing work it is necessary to carry out the work while stopping feed of the sheet for a predetermined period of time. While the section having the function of supplementing the difference between the continuous consumption of the sheet on the demand side and the actually fed length of the sheet on the feed side during the stoppage, is the dancer roll section 1, upon splicing as the feed of the sheet is momentarily braked and stopped, the tension in the running sheet would rise abruptly as shown in FIG. 3(A) relating to the prior art, due to the inertia of the tension roll 5 in the dancer roll section 1. In addition, there were shortcomings that after the splicing, sagging was produced in the sheet or the tension in the sheet became extraordinarily high due to unbalance between the feed speed of the sheet and the moving speed of the tension roll 5. Consequently, the prior art system involved various problems that many troubles such as breaking, deformation and instability of running of the sheet were generated.

SUMMARY OF THE INVENTION

It is therefore one object of the present invention to provide an improved splicing system, which is free from the above-mentioned shortcomings inherent to the splicing system in the prior art.

According to one feature of the present invention, there is provided a splicing system for paying out a rolled sheet and continuously feeding a sheet to a downstream machine, of the type that the system includes a sheet splicer for stopping a running sheet and splicing a tip end of another new sheet therewith, a tension roll in a dancer roll section for forming a sheet pool downstream of the sheet splicer, which tension roll is provided for the purpose of feeding the running sheet without changing the speed of the downstream machine, an accelerating roll for stopping a running old sheet and accelerating the new sheet upstream of the dancer roll section and downstream of the sheet splicer, and a guide roll provided downstream of the dancer roll section and upstream of the downstream machine for feeding the sheet coming from the dancer roll section to the downstream machine, in which system when a rotational speed of the accelerating roll is represented by $-N_2$, a rotational speed of the guide roll is represented by $+N_3$, and a rotational speed of a drive shaft for moving the tension roll in the dancer roll section is represented by $N_1$, the drive shaft is driven so as to fulfil the relation of $$N_1 = \frac{(-N_2) + N_3}{2},$$

and thereby variation of the tension in the sheet applied to the tension roll accompanying the variation of the rotational speed of the accelerating roll can be made zero.

According to the present invention, owing to the above-described construction of the splicing system, the feed speed of the sheet delivered through the dancer roll section to a single facer or a double facer in the next step of the process is a speed corresponding to a manufacturing speed of a corrugated cardboard sheet. The guide roll continues to rotate at a speed corresponding to the manufacturing speed of the corrugated cardboard sheet, the rotational speed of the accelerating roll is maintained nearly equal to the rotational speed of the guide roll, and so, feeding of the sheet is effected with the tension roll positioned nearly at a fixed location. In the sheet splicing work, when the rotational speed of the accelerating roll has been decelerated and stopped by controlling the speed of the accelerating motor and thereby feed of the raw material sheet from the mill roll stand has been stopped, the rotational speed $(-N_2)$ of the accelerating roll becomes zero, hence from the relation of $$N_1 = \frac{(-N_2) + N_3}{2},$$

the rotational speed $N_1$ of the drive shaft for moving the tension roll in the dancer roll section becomes $$N_1 = \frac{N_3}{2}\left(\text{because } \frac{N_2}{2} = 0\right),$$

and therefore, the tension roll moves at a speed of ½ times the sheet feed speed in the direction for reducing the sheet pool, so that the sheet pooled in the dancer roll section can be released without being accompanied by variation of the tension.

On the other hand, in the case where the sheet splicing has been finished and the sheet pooled in the dancer roll section is supplemented by accelerating the speed of the accelerating roll, also the tension roll moves in the opposite direction to that described above without generating variation of the tension in the sheet nor sagging of the sheet.

The above-mentioned and other objects, features and advantages of the present invention will become more apparent by reference to the following description of one preferred embodiment of the present invention taken in conjunction with the accompanying drawings.

BRIEF DESCRIPTION OF THE DRAWINGS

In the accompanying drawings:

FIG. 1(*b*) is a side view of the same;

FIG. 3(*b*) is a diagram showing a running behavior of a sheet and variations of a tension in the sheet upon splicing in the splicing system according to the present invention;

FIG. 3(*c*) is a diagram showing modes of variation of a tension in a sheet in the system known in the prior art and in the system according to the present invention;

FIG. 4(*a*) is a plan view of a splicing system in the prior art;

FIG. 4(*b*) is a side view of the same; and

FIG. 5 is a detailed partial side view showing an essential part in the system shown in FIG. 4(*b*).

Figure 1A:
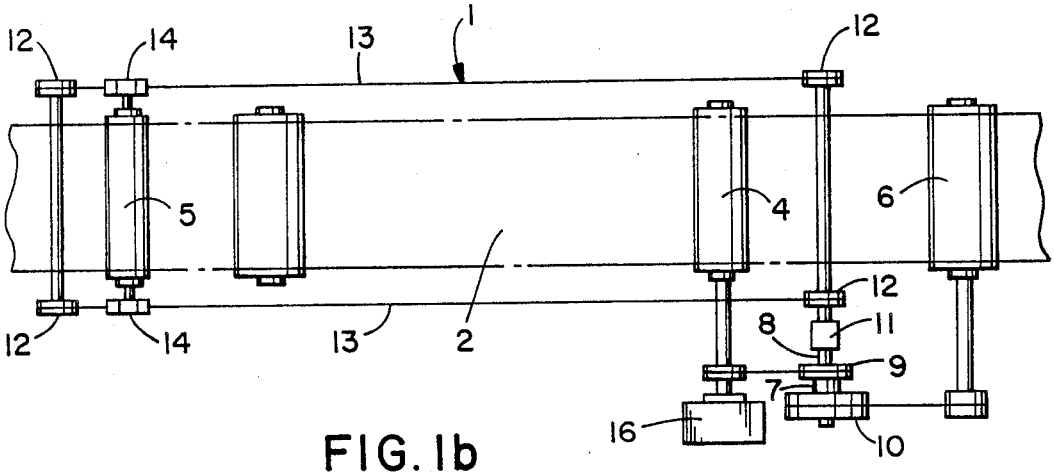
FIG. 1(*a*) is a plan view of a splicing system according to one preferred embodiment of the present invention.
Figure 1B:
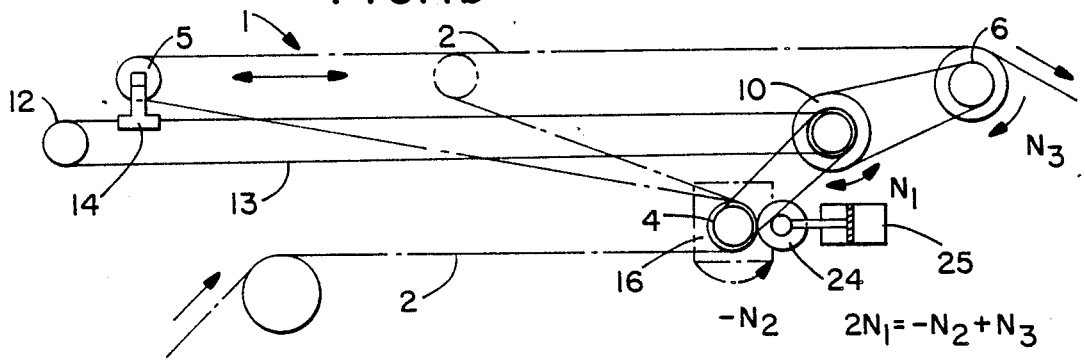

DESCRIPTION OF THE PREFERRED EMBODIMENT:

In the following, the present invention will be described in more detail in connection to one preferred embodiment of the invention illustrated in FIGS. 1, 2 and 3(*a*). It is to be noted that the respective rotational speeds $N_1$, $(-N_2)$ and $N_3$ are defined so that the rotational speed in the direction of increasing the amount of the sheet stock in the dancer roll section 1 may be positive and that in the direction of decreasing the stock amount may be negative.

Now, in the dancer roll section 1, the route of a continuous sheet 2 passing through a sheet splicer not shown and running around an accelerating roll 4, a tension roll 5 and a delivery section guide roll 6, respectively, and the capability of stocking a necessary amount of sheet to be consumed during a splicing operation, are the same as those employed in the prior art system shown in FIG. 4. However, the preferred embodiment of the present invention illustrated in FIG. 1 has a characteristic feature in that drive for the accelerating roll 4, movement of the tension roll 5 in the dancer roll section 1 and drive for the delivery section guide roll 6 are mutually interlocked via differential speed reduction gears 7 to perform effective control.

Figure 2:
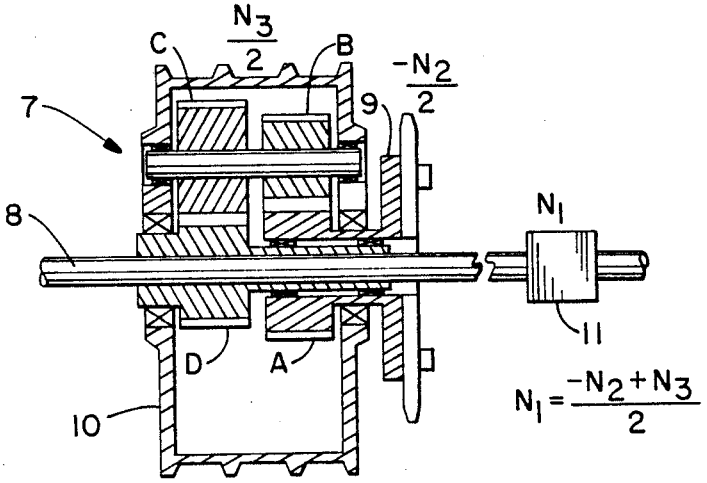
FIG. 2 is a cross-section front view of differential speed reduction gears employed in the system shown in FIG. 1.

The differential speed reduction gears 7 employed in one preferred embodiment of the present invention consists of a planetary gear mechanism as shown in FIG. 2, which comprises three rotary elements of a shaft 8, a flange 9 and a casing 10. In addition, in FIG. 2 reference characters A and D designate sun gears and reference characters B and C designate planet gears. As is well known by those skilled in the art, the relation among the rotational speeds of the respective rotary elements that is, the shaft 8, the flange 9 and the casing 10 is represented by $$N_1 = \frac{-N_2 + N_3}{2},$$

where symbol $N_1$ represents the rotational speed of the shaft 8, symbol $-N_2/2$ represents the rotational speed of the flange 9, and symbol $N_3/2$ represents the rotational speed of the casing 10.

Explaining now the construction and function of the dancer roll section 1, the dancer roll section 1 makes use of the differential reduction gears 7 which operate in the above-described manner, by rotating the shaft 8 the bearings 14 pivotably supporting the tension roll 5 in the dancer roll section 1 is reciprocated via a powder clutch 11, sprockets 12 and chains 13, the casing 10 is rotated at a rotational speed of $N_3/2$ by transmitting the rotation (at the rotational speed of $N_3$) of the sheet delivery section guide roll 6 thereto via power transmission means, and the flange 9 is rotated at a rotational speed of $-N_2/2$ by transmitting the rotation (at the rotational speed of $-N_2$) of the accelerating roll 4 that is driven by an accelerating motor 16 for controlling a sheet feeding state (deceleration, stoppage or acceleration) from a mill roll stand not shown, via power transmission means.

Figure 3A:
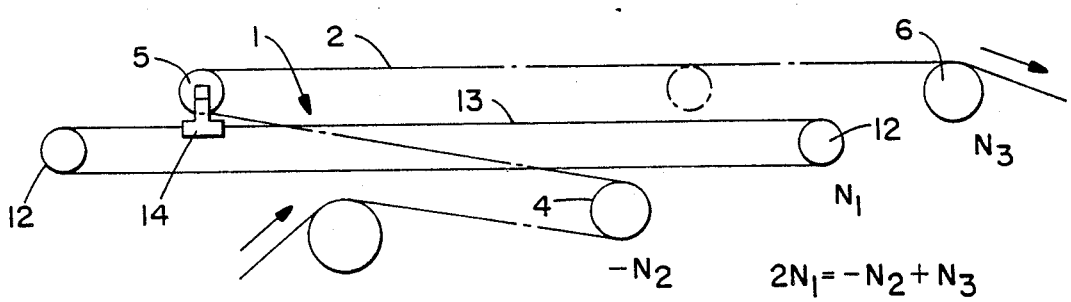
FIG. 3(*a*) is a schematic view showing preset rotational speeds of the respective portions in the illustrated embodiment.
Figure 3C:
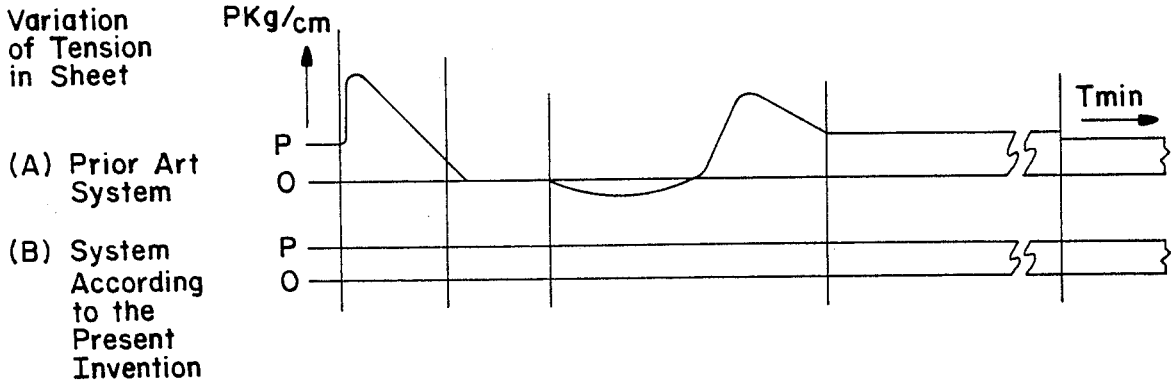
Figure 3B:
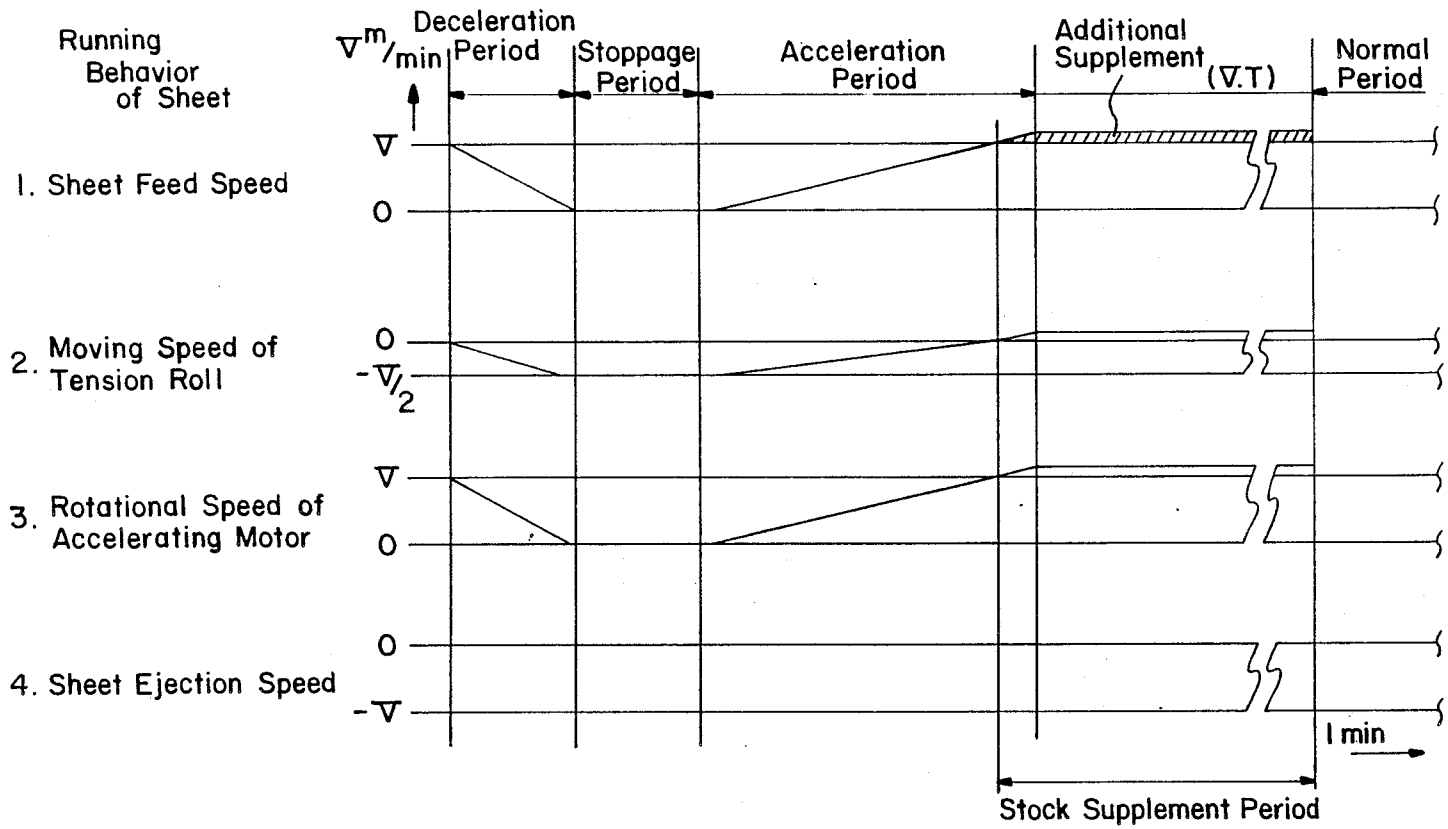

The running behavior of the sheet in the above-described system is shown in FIG. 3(*b*), in which the feed speed of the sheet delivered from the mill roll stand to the dancer roll section 1 is normally coincides with the circumferential speed of the accelerating roll 4 (only upon splicing, a press roll 24 is pressed against the accelerating roll 4 by the action of a cylinder 25), and by making that sheet feed speed equal to or a little faster than the ejection speed of the sheet delivered from the guide roll 6 in the dancer roll section, the position of the tension roll 5 is set to be stopped or to be moved very slowly to the left as seen in FIG. 3(*a*).

In addition, the ejection speed of the sheet delivered through the dancer roll section 1 to a single facer or a double facer in the next step of the process is a speed corresponding to the manufacturing speed of the corrugated cardboard sheet, and so, the casing 10 of the differential speed reduction gears 7 would continue to rotate at a rotational speed corresponding to the manufacturing speed of the corrugated cardboard sheet.

Accordingly upon sheet splicing, when the rotational speed of the accelerating roll 4 has been decelerated and stopped via the accelerating motor 16 and thus the feed of the raw material sheet from the mill roll stand has been stopped, the shaft 8 would rotate in the reverse direction, and the tension roll 5 would move rightwards as viewed in FIG. 3(*a*). The moving speed of the tension roll 5 at that time would be $$N_1 = \frac{N_3}{2} \left( \text{because } \frac{N_2}{2} = 0 \right)$$

in view of the relation of $$N_1 = \frac{-N_2 + N_3}{2},$$

that is, the moving speed would become ½ times the sheet ejection speed, and so, the sheet pooled in the dancer roll section 1 can be released without being accompanied by variation of the tension in the sheet (Since the tension roll is moved rightwards at the speed of $N_3/2$, that is, at the speed equal to half times the sheet speed $N_3$, variation of the tension in the sheet is none at all.). Owing to the above-mentioned capability, abrupt increase of the tension in the sheet caused by the inertia of the tension roll 5 which was a shortcoming of the prior art system, can be eliminated, and a constant tension can be maintained.

After finishment of the splicing work, the circumferential speed of the accelerating roll 4 is increased via the accelerating motor 16, and the sheet feed speed from the mill roll stand 15 to the dancer roll section 1 is accelerated. Until the sheet feed speed coincide with the sheet ejection speed, according to the relation of $$N_1 = \frac{-N_2 + N_3}{2},$$

the rightward moving speed of the tension roll 5 in the dancer roll section 1 is reduced by the amount corresponding to the increment of the sheet feed speed accelerated by the accelerating roll 4, and when the sheet feed speed and the sheet ejection speed coincides, the moving speed of the tension roll 5 becomes zero. Furthermore, the accelerating roll 4 is driven a little faster than the sheet ejection speed $N_3$, thus the tension roll 5 in the dancer roll section 1 is moved leftwards at the speed of $$N_1 = \frac{-N_2 + N_3}{2},$$

and thereafter, a sheet length corresponding to the area of the hatched portion in FIG. 3(*b*) becomes an additionally supplemented amount of the sheet stock in the dancer roll section 1. It is to be noted that after the sheet capacity that can be stocked in the dancer roll section 1 has been completely supplemented, the accelerating roll 4 is brought into a freely rotatable state (i.e. an idling state), and the movement of the tension roll 5 is stopped by making the sheet feed speed and the sheet ejection speed coinside with each other.

In addition, as described already in connection to the prior art system in FIG. 4, the powder clutch 11 directly coupled to the shaft 8 can delicately control the tension in the delivered sheet by regulating the action force for moving the tension roll 5. In other words, the tension in the sheet delivered to a single-facer or a double-facer in the next step of the process is generated by a tension applied at the delivery section and a braking force in the inverse direction produced by a braking action at the accelerating roll, and upon extraordinary increase of the sheet tension, the clutch 11 is made to slip. Thus, this system operates to control the sheet tension so that it can be maintained always within a predetermined range.

It is to be noted that the present invention should not be limited only to the above-described embodiment, but various changes and modifications in design can be made without departing from the spirit of the invention. For instance, when the speed on the sheet ejection side is represented by $N_3$, the speed on the deceleration/acceleration side is represented by $-N_2$, and the moving speed of the tension roll in the dancer roll section located therebetween is represented by $N_1$, the respective speed $N_1$, $-N_2$ and $N_3$ can be controlled by individual motors so as to fulfil the relation of $$N_1 = \frac{-N_2 + N_3}{2}.$$

In other words, by driving the tension roll in the dancer roll section at a moving speed $N_1$ which fulfils the relation of $$N_1 = \frac{-N_2 + N_3}{2},$$

an excessive sheet tension and sagging of the sheet can be eliminated. While the above explanation was made for the example of a single dancer (a single tension roll is provided), in the case of a double dancer (two tension rolls are provided), the same effect can be obtained by driving the tension rolls so as to fulfil the relation of $$N_1 = \frac{-N_2 + N_3}{4}.$$

Since the splicing system according to the present invention is constructed as described above, in the event that upon a sheet splicing work, the rotational speed of the accelerating roll has been reduced and running of the old sheet has been stopped, the tension roll in the dancer roll section can be moved towards the sheet ejection side so as to slacken the sheet tension in response to the deceleration and stoppage, while upon acceleration of the new sheet after the splicing, the moving speed of the tension roll can be reduced, stopped and reversed (so as to move in the opposite direction to the sheet ejection side), and thereby abrupt increase and decrease of the sheet tension generated upon every splicing work as described above, can be mitigated. Thereby, the problems to be resolved in the prior art such as breaking, deformation and running instability of the sheet, can be resolved. Accordingly, degradation of a productivity accompanying generation of troubles such as sheet breaking or the like, can be eliminated, moreover, variation of the tension is eliminated, and manufacturing of high-quality corrugated cardboard sheets is possible.

What is claimed is:

1. A splicing system for paying out a rolled sheet and continuously feeding a sheet to a downstream machine, which includes a sheet splicer for stopping a running sheet and splicing a tip end of another new sheet therewith, a tension roll in a dancer roll section for forming a sheet pool downstream of said sheet splicer, which tension roll is provided for the purpose of feeding the running sheet without changing the speed of said downstream machine, an accelerating roll for stopping a running old sheet and accelerating the new sheet upstream of said dancer roll section and downstream of said sheet splicer, and a guide roll provided downstream of said dancer roll section and upstream of said downstream machine for feeding the sheet coming from said dancer roll section to the downstream machine; characterized in that when a rotational speed of said accelerating roll is represented by $-N_2$, a rotational speed of said guide roll is represented by $+N_3$, and a rotational speed of a drive shaft for moving the tension roll in said dancer roll section is represented by $N_1$, said drive shaft is driven so as to fulfil the relation of $$N_1 = \frac{(-N_2) + N_3}{2},$$

and thereby variation of the tension in the sheet applied to said tension roll accompanying the variation of the rotational speed of said accelerating roll can be made zero, wherein the rotational speed of the accelerating roll is set to be somewhat faster than the rotational speed of the guide roll, and thereby the tension roll in the dancer roll section can be moved in the direction for increasing the pooled amount of the sheet, according to the rotational speed of $$N_1 = \frac{(-N_2) + N_3}{2},$$

and wherein the drive shaft for moving the tension roll in said dancer roll section is coupled to said guide roll and said accelerating roll via planetary gears.

2. A splicing system for paying out a rolled sheet and continuously feeding a sheet to a downstream machine, which includes a sheet splicer for stopping a running sheet and splicing a tip end of another new sheet therewith, a tension roll in a dancer roll section for forming a sheet pool downstream of said sheet splicer, which tension roll is provided for the purpose of feeding the running sheet without changing the speed of said downstream machine, an accelerating roll for stopping a running old sheet and accelerating the new sheet upstream of said dancer roll section and downstream of said sheet splicer, and a guide roll provided downstream of said dancer roll section and upstream of said downstream machine for feeding the sheet coming from said dancer roll section to the downstream machine; characterized in that when a rotational speed of said accelerating roll is represented by $-N_2$, a rotational speed of said guide roll is represented by $+N_3$, and a rotational speed of a drive shaft for moving the tension roll in said dancer roll section is represented by $N_1$, said drive shaft is driven so as to fulfil the relation of $$N_1 = \frac{(-N_2) + N_3}{2},$$

and thereby variation of the tension in the sheet applied to said tension roll accompanying the variation of the rotational speed of said accelerating roll can be made zero, wherein the drive shaft for moving the tension roll in said dancer roll section is coupled to said guide roll and said accelerating roll via planetary gears.

* * * * *